US005314114A

United States Patent [19]

Stone

[11] Patent Number: 5,314,114

[45] Date of Patent: * May 24, 1994

[54] FLIP-TOP RECLOSEABLE CARTON WITH POSITIVE CLOSURE ARRANGEMENT

[75] Inventor: James L. Stone, Grand Rapids, Mich.

[73] Assignee: Packaging Corporation of America, Evanston, Ill.

[ * ] Notice: The portion of the term of this patent subsequent to Oct. 13, 2009 has been disclaimed.

[21] Appl. No.: 990,602

[22] Filed: Dec. 14, 1992

[51] Int. Cl.[5] ..... B65D 5/54; B65D 5/56

[52] U.S. Cl. ..... 229/225; 220/416; 229/160.1; 493/95; 493/907

[58] Field of Search ..... 229/224, 225, 226, 160.1; 206/268, 273; 220/416, 418, 441, 443, 461, 462, 463; 493/93, 95-97, 217, 906, 907

[56] References Cited

U.S. PATENT DOCUMENTS

| | | | |
|---|---|---|---|
| 2,367,476 | 1/1945 | Tyrseck | 220/416 |
| 2,396,310 | 3/1946 | Yungblut | 229/225 |
| 2,881,967 | 4/1959 | Ringler | 229/160.1 |
| 2,951,627 | 9/1960 | Wenzel | 220/416 |
| 3,432,090 | 3/1969 | Engel | 229/226 |
| 3,524,581 | 8/1970 | Buttery | 229/226 |
| 3,708,108 | 1/1973 | Rosenburg, Jr. | 229/225 |
| 4,048,052 | 9/1977 | Tolaas | 229/224 |
| 4,083,455 | 4/1978 | Keating, Jr. | 229/226 |
| 4,289,239 | 9/1981 | Meyers | 229/226 |
| 4,948,038 | 8/1990 | Moeller | 206/273 |
| 4,986,420 | 1/1991 | Gunn et al. | 229/225 |
| 5,092,516 | 3/1992 | Kastanek | 229/226 |
| 5,154,343 | 10/1992 | Stone | 229/225 |

FOREIGN PATENT DOCUMENTS

| | | | |
|---|---|---|---|
| 1017728 | 9/1977 | Canada | 229/225 |
| 2229996 | 10/1990 | United Kingdom | 220/416 |

*Primary Examiner*—Gary E. Elkins
*Attorney, Agent, or Firm*—Arnold, White & Durkee

[57] ABSTRACT

A flip-top recloseable carton is provided in the form of a six-sided parallelopiped enclosure having opposing top and bottom walls, front and back walls, and side walls formed from corresponding panels and flaps defined on a unitary, continuous paperboard blank. The outer layers of the side walls and the front wall are provided with horizontal tear-strip sections which form an integral and continuous tear strip that permits a user to open the carton from its sealed form. Repeated closing and positive locking of the carton is realized by use of a die-cut portion on the inner layer of the front wall which includes a proximal flap and an island portion dispersed in forcibly displaceable mutual engagement. Once the engaging flap and island portion are disengaged forcibly by opening the carton lid, reclosing thereof leads to snap re-engagement of the flap and island elements accompanied by positive tactile and audible feedback indicative of effective carton closure.

15 Claims, 4 Drawing Sheets

FLIP-TOP RECLOSEABLE CARTON WITH POSITIVE CLOSURE ARRANGEMENT

FIELD OF THE INVENTION

The present invention relates generally to paperboard cartons or like containers. More specifically, the present invention relates to recloseable paperboard cartons which can store powdered or granular materials.

BACKGROUND OF THE INVENTION

Paperboard cartons are typically formed from rolls of paperboard which are cut into "blanks." Score lines are scribed between sections of a blank to divide the blank into rectangular sections and to facilitate folding of these sections with respect to one another. In forming a carton from the blank, a top, side, or bottom panel of the carton is initially left unsealed so that the carton may be filled with a product through the unsealed panel. Different equipment is typically used to fill the carton, depending on the panel which is left unsealed; "side-fill" equipment is used to fill a carton with an unsealed side panel, "top-fill" equipment is used to fill a carton with an unsealed top panel, and "bottom-fill" equipment is used to fill a carton with an unsealed bottom panel Once the carton is filled with a product, the carton is sealed and the filled carton is ready to be sold to a consumer.

With respect to powdered detergent applications, most detergent companies use "top-fill" equipment or "bottom-fill" equipment to fill powdered detergent into cartons prior to sealing the cartons. In order for a detergent carton design to be compatible with existing filling equipment, it is advantageous for the detergent carton to be constructed with the appropriate panel left unsealed so that the carton may be filled through the carton top or bottom.

In a variety of consumer packaging applications, not only is it advantageous to supply cartons or containers which are compatible with typical industry "filling" equipment, but it is also important to supply cartons which are capable of being conveniently, yet securely, opened and reclosed repeatedly. The ability to be repeatedly opened and closed down in a lockable manner is particularly important where the carton is used for storage of granular or powdered material, such as laundry detergent powder.

An exemplary recloseable carton design uses a carton lid which hingedly attaches to a back panel of a carton base. An integral tear strip is generally used to permit the opening of a carton which has been packed with the appropriate material and subsequently sealed. The lid is separated from the base by removing the tear strip and lifting the lid up. Subsequently, the carton is reclosed by pushing the lid back down to its original position.

Conventional recloseable cartons of the above-identified type suffer from disadvantages which severely restrict their use in certain consumer packaging applications, particularly where the packaged product constitutes granular or powdered material such as concentrated laundry detergent powder or the like. The present inventor has discovered that a major drawback in this regard is the general absence of a positive locking arrangement in combination with a carton design which is conducive to repeated open and reclose operations. More specifically, the previously discussed exemplary design has been found to be undesirable in certain applications because of the likelihood of the lid opening and leading to spillage of the contents thereof when such a closed carton is tipped over or otherwise disposed at an acute angle.

The present inventor has also discovered that such recloseable cartons can be improved by providing some form of positive indication, either tactile or audible, of the fact that an opened carton has been reclosed adequately in order to realize an effective locking position It has been determined in this regard that the presence of such tactile or audible feedback indicative of effective locking is desirable because the presence thereof provides consumers with a high "comfort" factor with respect to reclosure. Particularly in applications where the recloseable cartons are used to house granulated material having a restricted storage life once the storage container has been torn open, such positive feedback has bee determined to provide an apparent sense of reassurance to consumers as to retention of "freshness", "safety", or scent of the contained product.

Accordingly, there exists a distinct need for a recloseable, flip-top carton design which overcomes disadvantages of the above type associated with conventional recloseable paperboard cartons. The present invention effectively and conveniently realizes such a recloseable carton design.

SUMMARY OF THE INVENTION

In accordance with the foregoing, the present invention provides a paperboard carton of the flip-top type which is repeatedly recloseable by means of a positive locking arrangement adapted to provide positive tactile and/or audible feedback indicative of effective closure.

The present invention provides a recloseable paperboard carton adapted to be initially filled with a product through a top or bottom of the carton prior to sealing the carton. The carton is useful for containing granular or powdered material in the form of an enclosure which is easily assembled and conveniently opened and reclosed for effective dispensing of material contained therein. The recloseable carton is realized using an efficient and cost-effective manufacturing process.

According to a specific embodiment, the present invention provides a recloseable carton having a positive locking arrangement providing positive feedback indicative of effective reclosure, as will be described in detail below in conjunction with the accompanying drawings. The recloseable carton is in the form of a six-sided parallelopiped enclosure having opposing top and bottom walls, front and back walls, and side walls formed from corresponding panels and flaps defined on a unitary, continuous paperboard blank. The outer layers of the side walls and the front wall are provided with horizontal tear-strip sections which form an integral and continuous tear strip that functions as convenient means for opening the carton from its sealed form.

According to another embodiment of the present invention, repeated closing and positive locking of the carton is realized by using a cut-out portion on an inner layer of the front wall. The cut-out portion includes a proximal flap and an island portion dispersed in forcibly displaceable mutual engagement. Once the engaging flap and island portion are disengaged forcibly by opening the carton lid, reclosing thereof leads to snap reengagement of the flap and island portion elements accompanied by positive tactile and audible feedback indicative of effective carton closure.

BRIEF DESCRIPTION OF THE DRAWINGS

Other objects and advantages of the invention will become apparent upon reading the following detailed description and upon reference to the drawings, in which.

Figure 1:
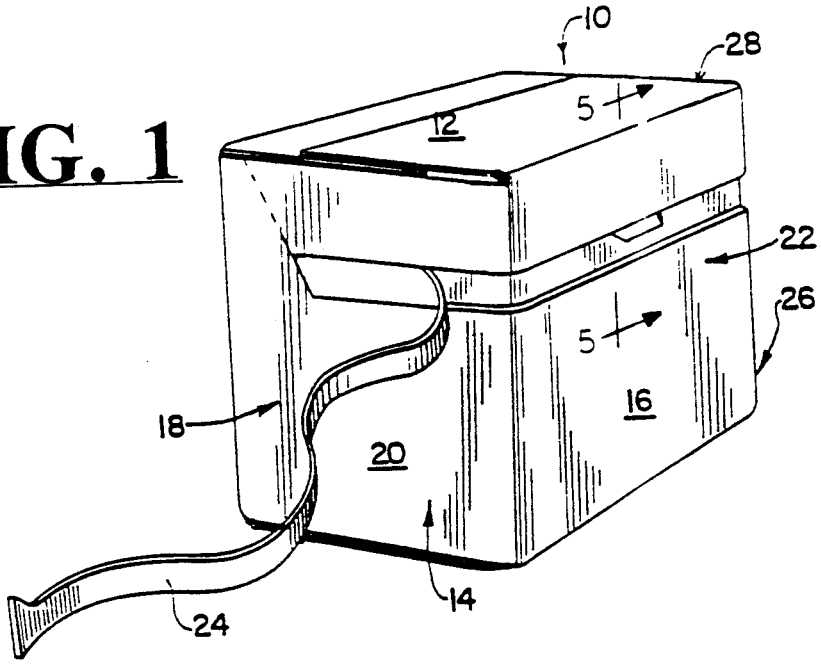
FIG. 1 is a perspective view of a recloseable paperboard carton in accordance with a preferred embodiment of the present invention, the carton being in its closed form with the tear strip partially pulled open.

While the invention is susceptible to various modifications and alternative forms, a specific embodiment thereof has been shown by way of example in the drawings and will herein be described in detail. It should be understood, however, that it is not intended to limit the invention to the particular forms disclosed, but on the contrary, the intention is to cover all modifications, equivalents, and alternatives falling within the spirit and scope of the invention as defined by the appended claims.

DESCRIPTION OF THE PREFERRED EMBODIMENTS

Referring now to the drawings and in particular to FIG. 1, there is shown a perspective view of an exemplary flip-top, recloseable paperboard carton having a positive locking arrangement in accordance with an illustrative embodiment of the present invention. In particular, FIG. 1 shows a recloseable carton which is a six-sided parallelopiped enclosure formed of three pairs of opposing, generally rectangular walls or panels. More specifically, the carton 10 includes opposing top and bottom walls 12 and 14, opposing front and back walls 16 and 18, and opposing side walls 20 and 22.

The relative upper portions of the outer layers of the side walls 20, 22 and the front wall 16 are provided with horizontal tear strip sections which effectively form an integral and continuous tear strip 24. The tear strip 24 is fairly conventional and located about the top three panels of the blank used to form the recloseable carton 10, as will be described in detail below with reference to FIG. 3.

The tear strip 24 effectively permits a user to conveniently open the carton 10 one it has been filled with the requisite contents and sealed. Tearing or pulling away of the tear strip 24, as indicated in FIG. 1, effectively releases the sealed edges of the side walls 20, 22 and the front wall 16 in order to delineate the carton 10 into a bottom base portion generally indicated as 26 and a upper lid or top portion generally indicated as 28. The arrangement is such that once the tear strip 24 has been completely pulled away, the carton lid 28 can be swung or raised upwardly away from the carton base 26 by virtue of a hinged attachment 29 of the horizontal edge of the top wall 12 to the corresponding horizontal edge of the back wall 18 of the carton 10.

Figure 2:
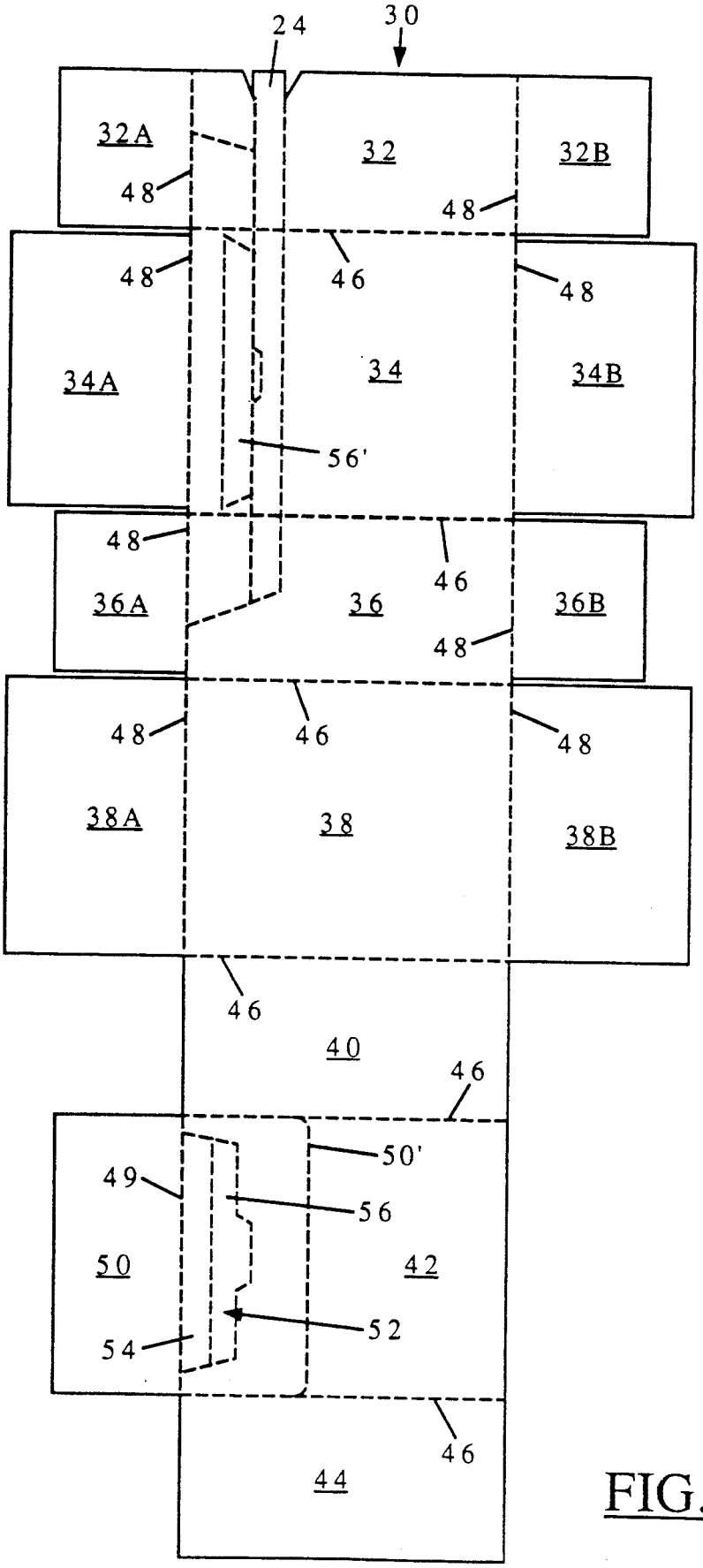
FIG. 2 is a top plan view of the paperboard blank used to form the recloseable carton shown at FIG. 1, according to an illustrative embodiment of this invention.

FIG. 2 illustrates a top plan view of a paperboard blank used for forming a recloseable flip-top carton of the type described above in connection with FIG. 1. As shown in FIG. 2, the blank 30 is in the form of a single, planar, unitary section of paperboard which includes seven vertically aligned, substantially rectangular panels 32, 34, 36, 38, 40, 42 and 44. The seven panels are linked to each other by horizontal score lines 46 which facilitate folding of the carton panels relative to each other. With respect to the manner in which these panels interact to define the closed carton shown in FIG. 1, the panel 32 corresponds to an outer layer of the side wall 22, the panel 34 corresponds to an outer layer of the front wall 16, the panel 36 corresponds to an outer layer of the side wall 20, the panel 38 corresponds to the back wall 18, the panel 40 corresponds to an inner layer of the side wall 22, the panel 42 corresponds to an inner layer of the front wall 16, and the panel 44 corresponds to an inner layer of the side wall 20.

Each of the upper four panels 32, 34, 36 and 38 of the blank 30 is provided with a pair of flaps connected along respective transverse edges (vertical in FIG. 2) by corresponding score lines 48. More specifically, the side wall outer panel 32 includes a left end flap 32A and a right end flap 32B. Similarly, left end and right end flaps 34A, 34B are respectively associated with the front wall outer panel 34; left and right end flaps 36A, 36B are respectively associated with the side wall outer panel 36; and left and right end flaps 38A, 38B are associated with the back wall panel 38.

The flaps associated with the upper four panels 32, 34, 36 and 38 interact in a conventional manner to form the top and bottom walls of a carton. With respect to the manner in which these flaps interact to form the closed carton 10 shown in FIG. 1, the left end flaps 32A, 34A, 36A and 38A correspond to the top wall 12, and the right end flaps 32B, 34B, 36B and 38B correspond to the bottom wall 14. In the illustrative embodiment of FIG. 2, the end flaps 32A–B have substantially the same transverse (vertical) and longitudinal (horizontal) dimensions, respectively, as the end flaps 36A–B; and the end flaps 34A–B have substantially the same transverse and longitudinal dimensions, respectively, as the end flaps 38A–B. However, the end flaps 32A–B and 36A–B associated with the side wall outer panels 32 and 36 have transverse dimensions which are substantially smaller than the transverse dimensions of the end flaps 34A–B and 38A–B.

In the embodiment of FIG. 2, the side wall outer panels 32 and 36 and front wall outer panel 34 have the transverse tear strip 24 extending integrally across the panels. The design and structure of the tear strip 24 and its operation in effective sealing and convenient tearing-open of a carton of the type disclosed herein is fairly conventional and, accordingly, not described in detail herein. It suffices to state that the tear strip 24 is substantially in the form of a pair of transverse parallel lines having a predefined depth of cut (at least about 30 percent) into the outer sides of the side wall outer panels 32, 36 and the front wall outer panel 34. The tear strip 24 includes a reinforcing tape (not shown) attached to the inner side of the tear strip 24 to prevent the strip from breaking apart as a result of the strip being removed from the carton 10 during the unsealing operation.

In the preferred embodiment, the side wall inner panels 40 and 44 and the front wall inner panel 42 function as a liner for the recloseable carton. The side wall inner panels 40 and 44 line the side wall outer panels 32 and 36, respectively, while the front wall inner panel 42 lines the front wall outer panel 34. To function most effectively as a liner, the transverse and longitudinal dimensions of the side wall inner panels 40 and 44 and the front wall inner panel 42 are slightly smaller than the corresponding dimensions of the side wall outer panels 32 and 36 and the front wall outer panel 34. Consequently, the liner panels 40, 42 and 44 fit snugly within the carton formed from the blank 30. Acting as a liner, the panels 40, 42 and 44 impart vertically-oriented structural support to the recloseable carton formed from the blank 30. This support permits several recloseable cartons to be safely stacked during storage and transit without the carton being damaged or destroyed due to stacking compression. For additional information concerning carton liners and their advantages, reference may be made to co-pending patent application Ser. No. 07/958,013 entitled *Paperboard Container Liner* and co-pending patent application Ser. No. 07/957,681 entitled *Improved Carton and Liner Tear-Tape Assembly*, both filed on Oct. 7, 1992, and incorporated herein by reference.

Using the construction of the blank 30, a carton formed from the blank 30 includes a liner without having to provide an additional paperboard blank to form the liner. The use of a single paperboard blank to produce a lined carton is relatively easy to manufacture and cost-effective. In addition, lined cartons formed from single blanks may be produced relatively fast because their production rate is only limited by the time it takes to produce one blank.

In accordance with the recloseable carton of the present invention, the front wall inner panel 42 is provided with an overhanging flap 50 which is connected to the left transverse edge of the panel 42 by a line of weakness 49 which is akin to the earlier-described lines of weakness used for linking the seven main panels together. The line of weakness 49 linking the overhanging flap 50 to the front wall inner panel 42 is creased sufficiently deep so as to permit bending or hingedly rotating the flap 50 downwardly and inwardly in order to be adhered, by an appropriate glue or like adhering means, to the inside surface of the panel 42, i.e., the surface of the panel 42 which is hidden from view in FIG. 2. The position of the flap 50 after it has been attached to the inside surface of the panel 42 is denoted by the reference numeral 50'.

Also, in accordance with the present invention, the front wall inner panel 42 has a die-cut portion 52 thereupon which includes a proximal flap 54 about the left transverse edge of the panel 42 by the same line of weakness 49 which links the overhanging flap 50 to the front wall inner panel 42. In addition, the die-cut portion 52 includes a flap-receiving or distal island portion 56 which is linked to the leading transverse edge of the proximal flap 54 and the surrounding sections of the panel 42 by means of weakening "nicks." The weakening nicks allow the distal island portion section 56 to be easily separated from both the surrounding portion of the front wall inner panel 42 and the proximal flap 54.

In particular, the die-cut portion 52, including the proximal flap 54 and the distal island portion 56, is designed to be such that the island portion 56 ma be adhered in a fixed manner to the inside surface of the front wall outer panel 34 above the tear-strip 24 generally in the position indicated in dashed lines by the numeral 56'. The arrangement is such that when the recloseable carton of FIG. 1 is formed using the carton blank shown in FIG. 2 and the carton 10 is initially opened by tearing away the tear-strip 24 and upwardly raising the lid 28 thereof, the island portion 56 on the cut-out portion 52 breaks free of its restricting nicks and remains attached to the lid 28 about the inside surface of the front wall outer panel 34 at position 56'.

A key advantage with respect to the above-described flap arrangement using the die-cut portion 52 is that when the carton formed from the blank 30 is opened by raising the lid 28, the proximal flap 54 is also rotated outwardly and upwardly. Subsequently, when the carton is closed by replacing the lid 28 to its initial closed position, the island portion 56 depresses the proximal flap 54 in a downward direction. More importantly, when the lid is closed down to such an extent that the island portion 56 moves down beyond the extension of the proximal flap 54, the island portion 56 snaps into a locked position and is restrained from upward movement by the confining action of the proximal flap 54 exerted upon the opposing transverse edge of the island portion 56.

As a result, the reclosed lid can only be opened by the exertion of a direct force sufficient to snap the island portion 56 back out of engagement with the proximal flap 54 by virtue of the upward and outward rotation thereof due to the opening of the lid. The above-described "snap" action undergone by the island portion 56 relative to the proximal flap 54 as the lid 28 of the carton 10 is reclosed provides positive tactile as well as audible feedback indicative of effective reclosing and, more importantly, locking of the lid 28 relative to the base section 26 of the carton 10.

The manner in which the carton 10 shown in FIG. 1 is assembled from the paperboard blank 30 is fairly conventional except for the above-described manner according to which the overhanging flap 50 and the die-cut portion 52 (including the proximal flap 54 and the island portion 56) is folded and fixedly adhered to the corresponding portions of the blank panels. The overall operations involved in assembling the blank 30 into the carton 10 are well-known to those skilled in the art of paperboard packaging containers and is, accordingly, not described in detail herein.

Figure 3:
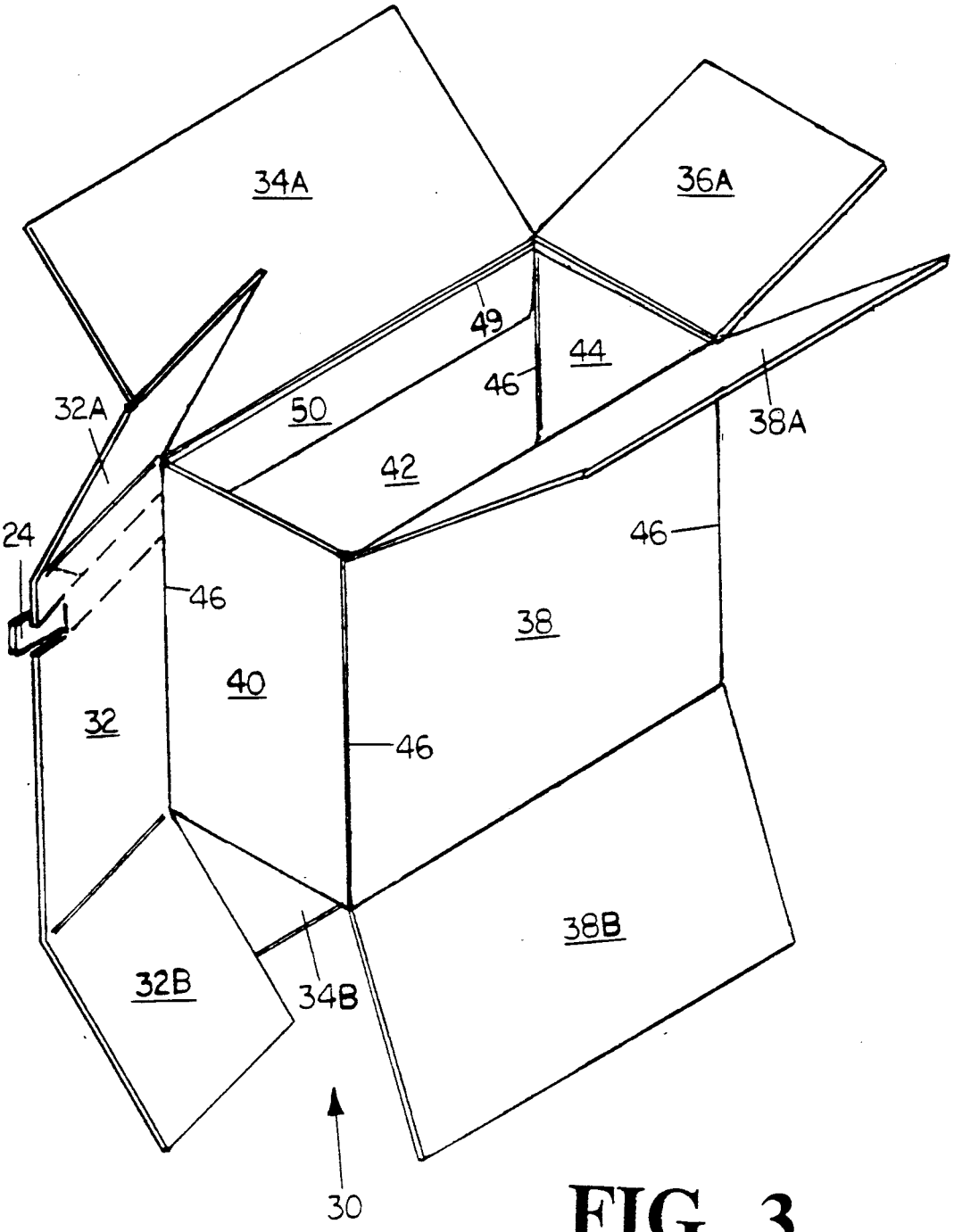
FIG. 3 is a perspective view of the paperboard blank of FIG. 2 in a partially-folded condition.

Referring to FIG. 3, it is sufficient to state herein that the blank 30 is initially folded and glued to form an open-sided generally rectangular, four-sided container by appropriately folding the seven main panels 32, 34, 36, 38, 40, 42 and 44 about the corresponding score lines or lines of weakness 46. The recloseable carton 10 of FIG. 1 is basically defined as an enclosure formed by the various panels and end flaps which define the carton blank 30. In particular, the overhanging flap 50 is first folded to the extent of 180° about the line of weakness 49 and glued or otherwise adhered so that it lies permanently against the inner side of the front wall inner panel 42.

Subsequently, the carton blank 30 is formed into a generally rectangular, four-sided tubular body by successively folding each of the seven main panels about the transverse lines of weakness 46 which link adjoining panels by the extent of 90° so that the front wall outer panel 34 is effectively positioned with its inner surface positioned against the outer surface of the front wall inner panel 42. At this point, the external surface of the island portion 56 which contacts the inner surface of the front wall outer panel 34 is glued or otherwise fixedly adhered thereto. The proximal flap 54 is not affixed to the corresponding inner surface of the front wall outer panel 34 but, instead, remains in contact therewith by virtue of being linked to the island portion 56 through the connection using the weak nicks described above.

To securely hold the blank 30 in the form of a four-sided tubular body, the outer surface of the side wall inner panel 44 is fixedly adhered by adhesive, such as glue, to the inner surface of the side wall outer panel 36. Similarly, the outer surface of the side wall inner panel 40 is fixedly adhered to the inner surface of the side wall outer panel 32.

The open-ended tubular body formed as described above is then completed into the form of the carton 10 by appropriately folding inward the outwardly extending end flaps and gluing together correspondingly opposed sections thereof. This assembly is preferably performed in two stages: first, closing and sealing one end (top or bottom) of the carton, and next filling the box with the requisite contents prior to closing the remaining end of the carton to yield a closed and entirely sealed carton as disclosed in FIG. 1. In powdered detergent applications and the like, the "top/bottom-fill" design of the carton 10 formed from the carton blank 30 is advantageous because most detergent companies use equipment adapted for filling detergent through the top or bottom of cartons.

In its closed form, the carton 10 is a substantially parallelopiped enclosure formed by opposing top and bottom walls 12, 14 which are respectively formed from (i) the combination of folded and glued flaps 32A, 34A, 36A and 38A, and (ii) the combination of folded and glued flaps 32B, 34B, 36B and 38B; opposing front and back walls 16 and 18 respectively formed from (i) the front wall outer panel 34 in conjunction with the front wall inner panel 42, and (ii) the back wall panel 38; and opposing side walls 20, 22 respectively formed from (i) the side wall outer panel 36 in conjunction with the side wall inner panel 44, and (ii) the side wall outer panel 32 in conjunction with the side wall inner panel 40.

Figure 4:
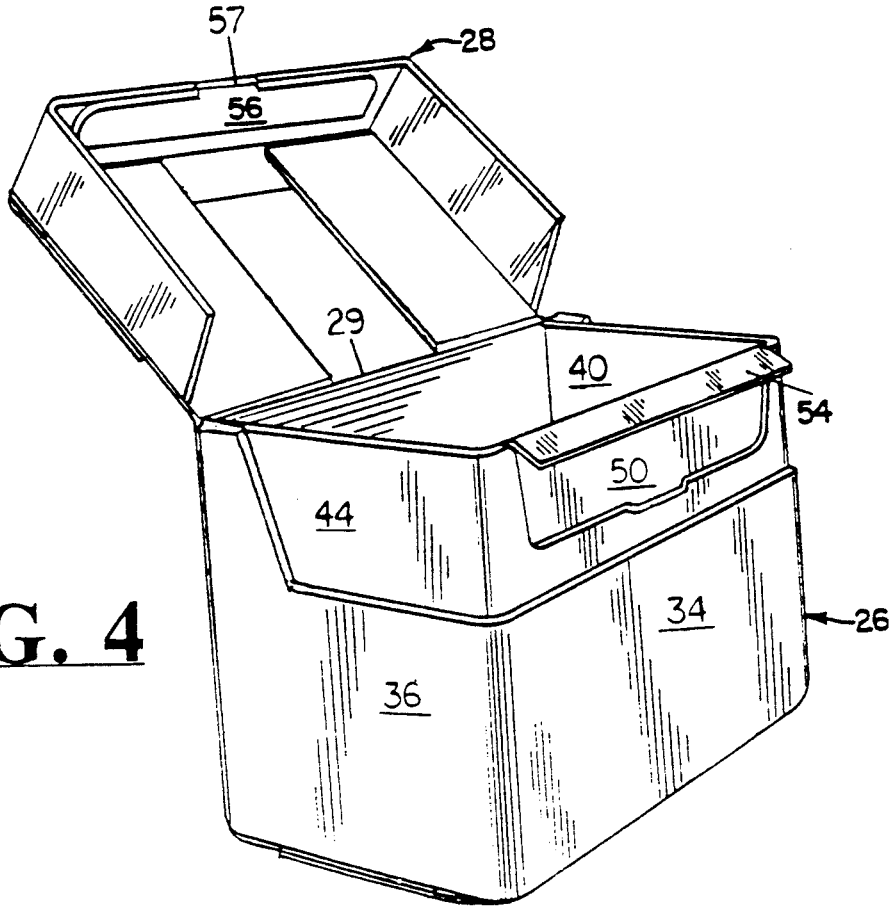
FIG. 4 is a perspective view of the recloseable carton of FIG. 1, as shown in its open condition with the lid raised upwardly to open the carton.
Figure 5:
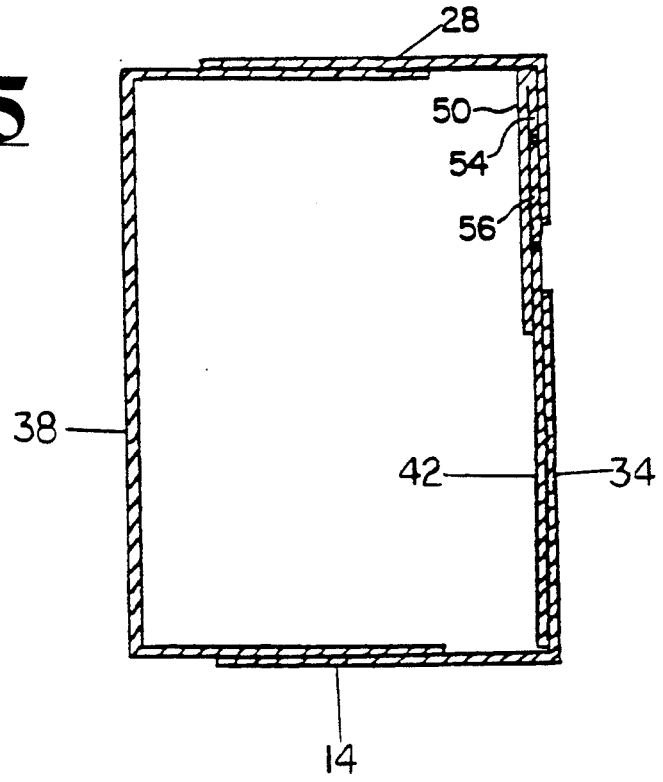
FIG. 5 is a segmented cross-sectional view taken along line 5—5 in FIG. 1 and illustrating the positive locking arrangement of the recloseable carton of the present invention.
Figure 6:
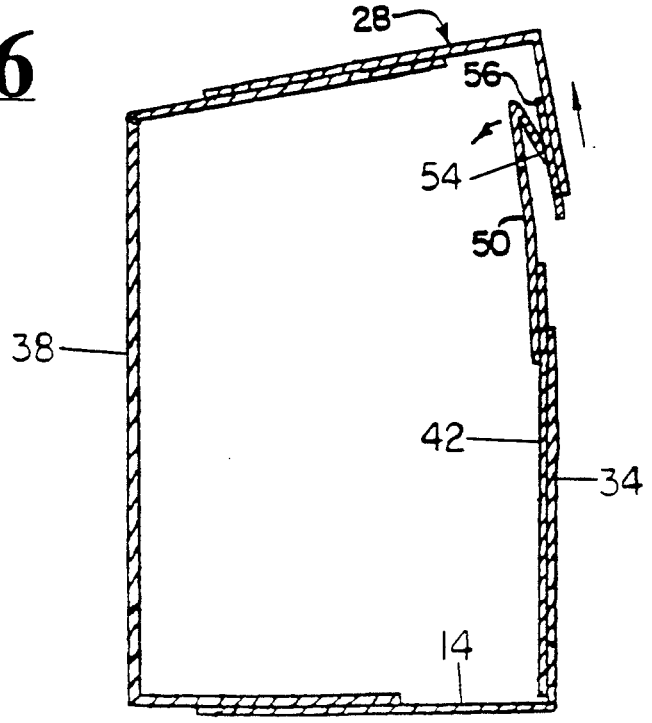
FIG. 6 is a similar segmented cross-sectional view of the positive locking arrangement showing the carton in a partially open condition.

Referring now in particular to FIGS. 4, 5 and 6, there are shown illustrations which facilitate an understanding of the manner in which the positive recloseable locking arrangement functions in accordance with the recloseable carton of the present invention. As particularly shown in the segmented cross-sectional view of FIG. 5, when the carton is in its sealed condition, the island portion 56 remains attached to the proximal flap 54 by virtue of the weak nicks through which the two elements are linked. In addition, the island portion 56 is permanently adhered to the corresponding inner surface of the lid 28. At the same time, both the island portion 56 and the proximal flap 54 also remain in contact with the folded over overhanging flap 50 of the front wall inner panel 42.

When the tear strip 24 has been torn away and the box is opened by pushing the lid 28 in an upwardly direction (as indicated by the large arrow in the segmented cross-sectional of FIG. 6), the upper transverse edge of the island portion 56 pushes against the corresponding opposing transverse edge of the proximal flap 54. When the upward force exerted upon the lid 28 sufficiently forces the proximal flap 54 as well as a portion of the overhanging flap 50 to "give" in the general direction of the small arrow (see FIG. 6), the island portion 56 clears the restriction presented thereto by the proximal flap 54 and the lid 28 becomes free to be opened. It should be noted that the upward movement of the lid 28 and island portion 56 initially causes the proximal flap 54 to be hingedly rotated in an upward direction until the upward movement, in combination with the "give" of the proximal flap 54 and the overhanging flap 50, allows the island portion 56 to clear the proximal flap 54. As shown in FIG. 4, the island portion 56 includes a tab 57 which can be grasped by a user for assistance in opening the lid 28.

When the recloseable carton 10 is reclosed by closing the lid 28 back to its original position, a similar interaction between the proximal flap 54 and the island portion 56 takes place. More specifically, downward movement of the lid 28 causes the island portion 56 attached thereto to move against proximal flap 54. As the downward force is continued to be exerted, the island portion 56 causes the flap 54 to be hingedly rotated in a downward direction while, at the same time, causing the proximal flap 54 and the overhanging flap 50 to again "give" until the island portion 56 completely bypasses the flap 54 and snaps into a locked position with contact between opposing transverse edges of the island portion 56 and the proximal flap 54. This snap/locking action produces the above-described positive tactile and audible feedback when the lid 28 has been effectively locked.

A significant advantage with the above-described structural design for the positive closure arrangement is that the interlocking elements, i.e., the proximal flap 54 and the distal island portion 56, are both originally formed on the front wall inner panel of the blank. In particular, this design prevents any possibility of the elements being separated from each other or, more importantly, from the carton blank, as a result of any step involved in the assembly process.

The design is also advantageous in that it avoid unnecessary board build-up resulting from folding over of panel sections in order to define the interlocking elements. More specifically, the interlocking action of these elements, as described above with respect to FIGS. 4–6, is realized with minimal board build-up particularly in the "sandwiched" layer portions (see, for instance, FIGS. 5 and 6) where the overlapping panel sections are adjacently positioned to define the container walls. As a result, the carton panel cuts necessary for proper assembly can be made relatively straight (as opposed to being tapered) so that the resulting assembled carton has a substantially "square" configuration. This eliminates the need for more exotic mechanical packaging equipment used in filling and sealing.

While the present invention has been described with reference to one or more particular embodiment, those skilled in the art will recognize that many changes may be made thereto without departing from the spirit and scope of the present invention. For example, in one embodiment the design of the panels 40, 42 and 44 of the blank 30 in FIG. 3 is modified so that the panels have a shorter longitudinal (vertical in FIG. 3) dimension so that the panels line only an upper one-third to one-half of the side wall outer panels 32 and 36 and the front wall outer panel 34. In another embodiment, an additional panel is hingedly connected to the side wall inner panel 44 of FIG. 2 so as to function as a back wall inner panel. The additional panel lines the back wall panel 38 and has transverse and horizontal dimensions slightly smaller than the corresponding dimensions of the back wall panel 38. Each of these embodiments and obvious variations thereof is contemplated as falling within the spirit and scope of the claimed invention, which is set forth in the following claims.

What is claimed is:

1. A recloseable paperboard carton, comprising:

opposing top and bottom walls, opposing front and back walls, and opposing side walls;

wherein the side walls and front wall include inner and outer layers, an upper portion of the outer layers including an integral and continuous horizontal tea strip for opening up the carton from a sealed form to form a lid hingedly attached to a base section, and the inner layers being disposed adjacent to the upper portion of the outer layers; and wherein the inner layer of the front wall includes a flap and a flap-receiving portion disposed in forcibly displaceable mutual engagement such that opening the carton lid exerts a force which disengages the mutual engagement between the flap and the flap-receiving portion, and reclosing the lid leads to snap re-engagement of the flap and the flap-receiving portion.

2. The recloseable paperboard carton as recited in claim 1, wherein the snap re-engagement of the flap and the flap-receiving portion is accompanied by positive tactile and audible feedback.

3. The recloseable paperboard carton as recited in claim 2, wherein the carton is assembled such that the flap-receiving portion is fixedly attached to an inner surface of the carton lid and at the same time separatably attached to the flap, and wherein opening of the lid separates the flap-receiving portion from the flap while retaining the flap on the inner layer of the front wall.

4. The recloseable paperboard carton as recited in claim 3 wherein the flap-receiving portion includes an island portion.

5. The recloseable paperboard carton as recited in claim 3 wherein the flap and the flap-receiving portion are separatably linked to each other about opposing transverse edges thereof, a distal transverse edge of the flap-receiving portion being separatably attached to an inner surface of the front wall outer layer, wherein opening of the carton lid causes the flap-receiving portion to be separated from the flap and the front wall inner layer and be retained on the inner surface of the carton lid.

6. The recloseable paperboard carton as recited in claim 5 wherein opening of the carton lid causes the opposing transverse edge of the flap-receiving portion to push against the opposing transverse edge of the flap until the engagement therebetween is released by relative inward movement of the flap and the front wall inner layer to which it is attached.

7. The recloseable paperboard carton as recited in claim 6 wherein the flap-receiving portion includes a tab adapted to be grasped by a user in opening the carton lid.

8. The recloseable paperboard carton as recited in claim 5 wherein reclosing of the carton lid causes re-engagement between the opposed transverse edges of the flap-receiving portion and the flap by interaction between the flap and the flap-receiving portion wherein the flap and the front wall inner layer to which it is attached undergo relative inward movement until the flap-receiving portion realizes snap engagement between the opposed transverse edges accompanied by the positive tactile and audible feedback.

9. The recloseable paperboard carton as recited in claim 3, wherein the inner layer of the front wall further includes an overhanging section connected to an inner surface of the front wall inner layer, the overhanging section being adjacent to the flap and the flap-receiving portion.

10. A recloseable paperboard carton, comprising:

opposing top and bottom walls, opposing front and back walls, and opposing side walls;

wherein the side walls and front wall include inner and outer layers, an upper portion of the outer layers including an integral and continuous horizontal tear strip for opening up the carton from a sealed form to form a lid hingedly attached to a base section, and the inner layers being disposed adjacent to the upper portion of the outer layers;

wherein the inner layer of the front wall includes a die-cut portion, disposed in proximity to the tear strip, having (i) a flap arranged substantially parallel to the tear strip, the flap having a first transverse edge hingedly connected to the front wall inner layer and (ii) an island portion separatably linked to a second transverse edge of the flap and surrounding sections of the front wall inner layer by means of weakening nicks, an outer surface of the island portion being fixedly attached to an inner surface of the front wall outer layer; and wherein the flap and the island portion are disposed in forcibly displaceable mutual engagement such that removing the tear strip and opening the carton lid causes the island portion to break free of the weakening nicks and to disengage the mutual engagement, and reclosing the lid leads to snap re-engagement of the flap and the island portion.

11. A method of producing a recloseable paperboard carton, comprising the steps of:

providing a paperboard blank including seven substantially rectangular panels hingedly connected to each other by horizontal score lines, the seven panels including a plurality of outer panels corresponding to outer layers of the carton and a plurality of inner panels corresponding to inner layers of the carton, each of the outer panels having a pair of end flaps hingedly connected to opposing transverse edges of each of the outer panels, selected ones of the outer panels having a transverse tear strip extending integrally across the selected ones of the outer panels, and one of the inner panels including a flap and a flap-receiving portion disposed in forcibly displaceable mutual engagement;

forming the blank into a generally rectangular, four-sided tubular body by successively folding each of the outer and inner panels about the horizontal score lines to the extent of 90° so that the inner panels are positioned within the outer panels;

adhering the flap-receiving portion to an inner surface of an adjacent one of the outer panels; and folding the pair of end flaps of each of the outer panels to form top and bottom walls of the carton.

12. The method as recited in claim 11, further comprising the step of adhering an outer surface of one of the inner panels to an inner surface of an adjacent one of the outer panels.

13. The method as recited in claim 11, further including the step of removing the tear strip to form a carton having a lid and a base section.

14. The method as recited in claim 13, further including the step of opening the lid by exerting a force which disengages the mutual engagement between the flap and the flap-receiving portion.

15. The method as recited in claim 14, further including the step of reclosing the lid by snap re-engagement of the flap and the flap-receiving portion.

* * * * *